US006050847A

United States Patent [19]

Kawakami et al.

[11] Patent Number: 6,050,847

[45] Date of Patent: Apr. 18, 2000

[54] CORD GUARD

[75] Inventors: Takahide Kawakami; Toshio Matsumoto; Takanori Kanou; Kazuma Oshima, all of Anjo, Japan

[73] Assignee: Makita Corporation, Anjo, Japan

[21] Appl. No.: 09/339,672

[22] Filed: Jun. 24, 1999

[30] Foreign Application Priority Data

Jun. 25, 1998 [JP] Japan ..... 10-194960

[51] Int. Cl.[7] ..... H01R 13/56

[52] U.S. Cl. ..... 439/447

[58] Field of Search ..... 439/447, 448

[56] References Cited

U.S. PATENT DOCUMENTS

| | | | |
|---|---|---|---|
| 1,574,020 | 2/1926 | Black et al. | 439/447 |
| 2,180,399 | 11/1939 | Clark | 439/447 |
| 3,665,374 | 5/1972 | Denton | 439/447 |
| 4,082,422 | 4/1978 | Kloots | 439/447 |
| 4,585,922 | 4/1986 | Berensin | 439/447 |
| 5,304,073 | 4/1994 | Golobay et al. | 439/447 |

FOREIGN PATENT DOCUMENTS 63-46892 3/1988 Japan .

*Primary Examiner*—Gary F. Paumen
*Attorney, Agent, or Firm*—Davis and Bujold

[57] ABSTRACT

The cord guard 1 having a cylindrical hollow passage 5 into which a cord 3 can be inserted and a flange portion 11 at one end which is retained by a cord guard retainer 9 in a half housing 7. The cord guard 1 further having a tapering wall portion 13 the wall thickness of which is gradually reduced from the flange portion 11 toward the free end, a constant wall portion 15 extending in series from the tapering wall portion 13 further toward the free end with its wall thickness constant, and a thicker wall ring flange 17 provided along the periphery of the free end of the constant wall portion 15. The wall thickness and the length of the constant wall portion 15 are determined such that the constant wall portion 15 is provided with a bending strength low enough that it is flexed smoothly together with the cord 3 when a load approximately equal to the weight of the cord 3 is applied as a bending load.

5 Claims, 4 Drawing Sheets

CORD GUARD

FIELD OF THE INVENTION

The present intention relates to a cord guard which protects a cord, for supplying an instrument, such as a power tool, with electric power, in its connection part with the instrument.

BACKGROUND OF THE INVENTION

Conventionally, for a cord guard protecting a cord connected with a power tool, it is known that the cord is inserted into one end of the power tool. The cord and guard are fixed in the housing of the power tool. The cord guard has a tapered tubular portion the wall thickness of which is reduced with a constant taper toward the other end (e.g. see Japanese Non-examined Utility Model Publication No. 63-46892).

Such a cord guard is mounted on the cord for the purpose of enhancing the cords durability. More specifically, the cord is prevented from being abruptly bent or kinked at the exit of the housing, since the cord guard is flexed smoothly when the cord is pulled taut while the power tool is in use. Accordingly, the cord guard itself has a certain degree of bending strength such that it will not kink by a light load approximately equal to the weight of the cord.

For example, when a worker installs a lightweight ceiling with a power tool, such as an electric screw driver at a construction site, the worker sets a screw on the tip of the driver bit of the electric screw driver, and then, screws the ceiling material with the driver bit pointed upward. This operation is repeated over and over again. In this case, the cord applies a load approximately equal to its own weight.

While, as aforementioned, the conventional cord guard has a certain degree of bending strength so that it will not flex or bend with such a light load as is approximately equal to the weight of the cord. As a result, the cord is abruptly bent or kinked at the second free end of the conventional cord guard.

Now, the problem is that the cord is frayed and ultimately disconnected before long if it is repeatedly bent or kinked abruptly at the second free end of the cord guard. For example, during installation of a lightweight ceiling with a screw driver, generally tens of thousands of repeated operations result in fraying the cord, and each time the cord is frayed, the operations must be interrupted to repair the cord, which is really troublesome. Since wages for installing a lightweight ceiling depend on how many ceiling materials the worker can install within a limited time, a cord which needs repairing after being used only tens of thousands of times is not sufficiently durable. Therefore, it is expected that the durability of the cord will be enhanced.

SUMMARY OF THE INVENTION

Accordingly, the object of the present invention is to provide a cord guard for enhancing the durability of a cord by preventing the cord from being abruptly bent or kinked at the free end of the cord guard by a load approximately equal to the weight of the cord.

In order to attain this object, a cord guard of the present invention was made. The cord guard, into which a cord for supplying an instrument with electric power is inserted, one end of which is fixed to the instrument, and which has a tapering wall portion the wall thickness of which is gradually reduced toward the free end and a thicker wall ring flange provided along the periphery of the free end.

The cord guard includes a constant wall portion, provided in series from the tapering wall portion, capable of flexing smoothly from the end of the tapering wall portion when a load approximately equal to the weight of the cord is applied.

By adopting the cord guard of the present invention, even in cases where an instrument is swung up and down over and over again with a load approximately equal to the weight of the cord, such as a case where a worker installs a lightweight ceiling with a screw driver, the cord is flexed together with the constant wall portion of the cord guard. Therefore, the cord is never abruptly bent or kinked at the free end of the cord guard, thereby largely improving the durability of the cord.

The constant wall portion may be formed as a cylindrical body the wall thickness of which is constant and approximately the same as that of the end of the tapering wall portion. With such a formation, it would be easy for the constant wall portion to flex smoothly from the end of the tapering wall portion.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
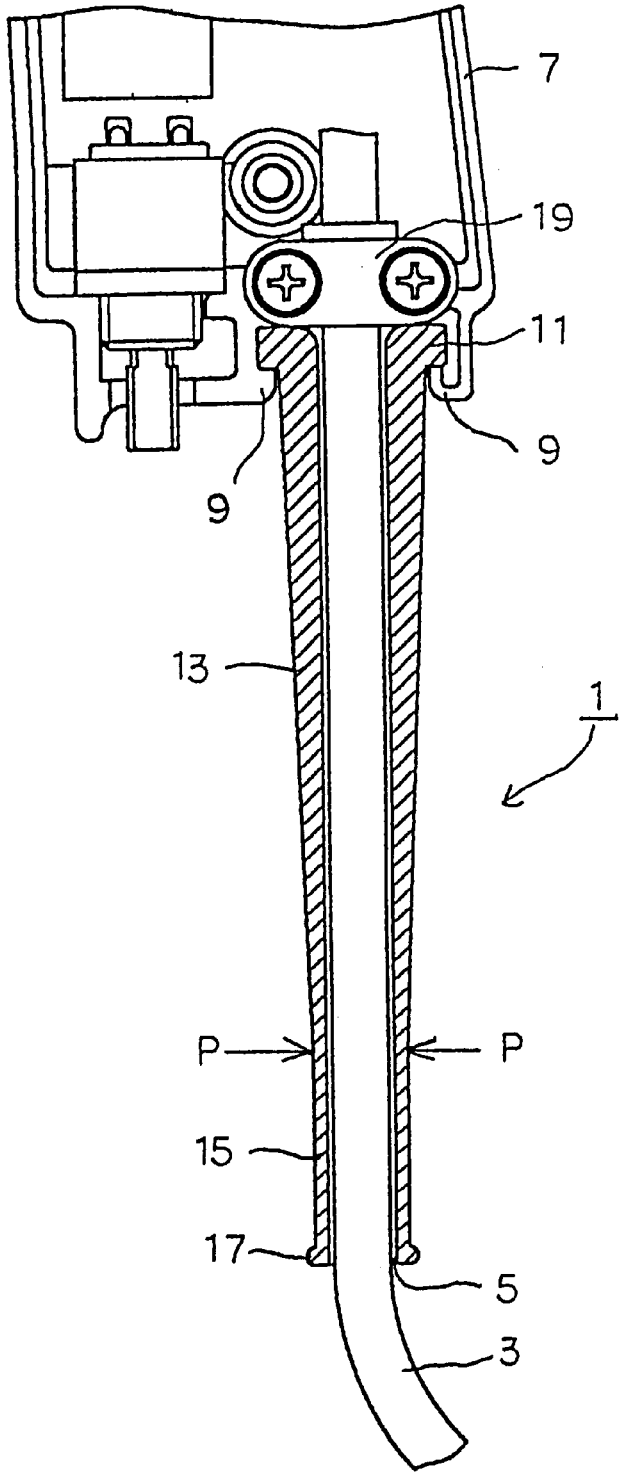
FIG. 1 is a sectional view showing a cord guard according to a first embodiment.

A cord guard according to a first embodiment is for use with an electric screw driver. As shown in FIG. 1, a cord guard 1 according, to this first embodiment has a cylindrical hollow passage 5 into which a cord 3 can be inserted and a flange portion 11 at a first end thereof which is retained by a cord guard retainer 9 in a half housing 7. Furthermore, the cord guard 1 comprises a tapering wall portion 13 the wall thickness of which gradually reduces from the flange portion 11 toward the free secured end and a constant wall portion 15 extending in series from the tapering wall portion 13 further toward the second free end with its wall thickness being a constant thickness. In FIG. 1, the constant wall portion 15 commences at point P. Also, a thicker wall ring flange 17 is provided along the periphery of the second free end of the constant wall portion 15.

The wall thickness and the length of the constant wall portion 15 are determined such that the constant wall portion 15 is provided with a bending strength low enough that it is flexed smoothly ahead of point P, together with the cord 3, when a load approximately equal to the weight of the cord 3 is applied as a bending load. On the other hand, the tapering wall portion 13 is provided with a bending strength higher than that of the constant wall portion 15 so that it can hardly be flexed with such a light load as is approximately equal to the weight of the cord 3. The cord 3 is inserted into the cylindrical hollow passage 5 of the cord guard 1 and is secured, via a cord clamp 19, to the half housing 7. The cord guard 1 is set with its flange portion 11 retained by the cord guard retainer 9 so as not to separate from the half housing 7.

Figure 2:
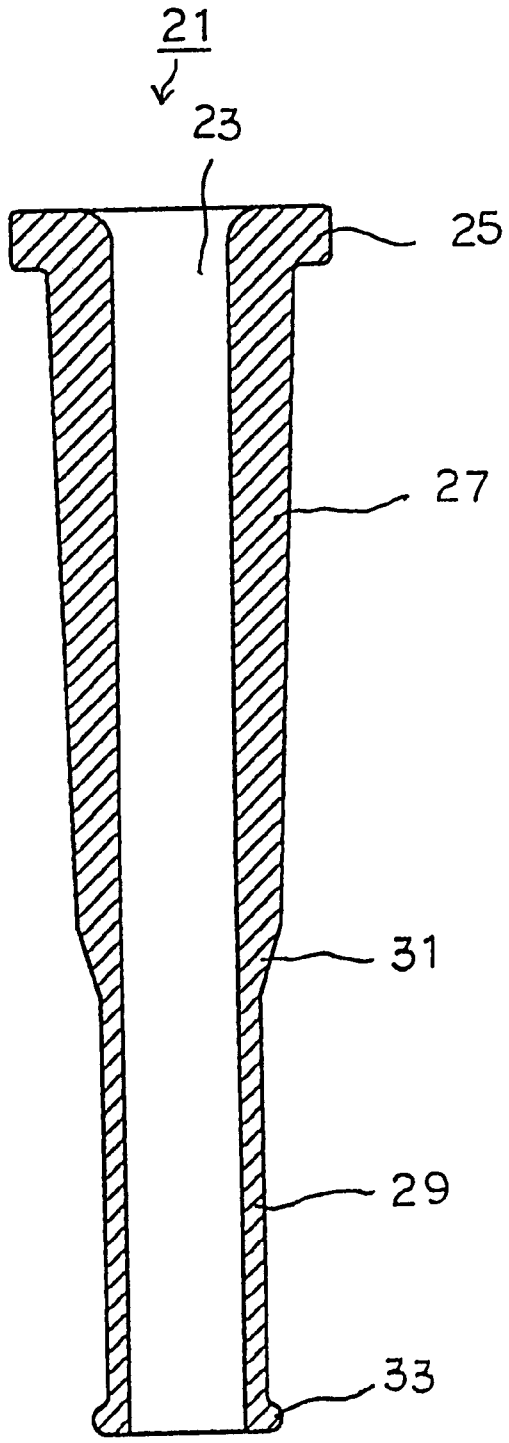
FIG. 2 is a sectional view showing a cord guard according to a second embodiment.

A second embodiment of the cord guard 21 is now described as shown in FIG. 2. The details of the electric screw driver from the first embodiment of the cord guard 1 from FIG. 1 have been omitted for reasons of clarity. As shown in FIG. 2, a cord guard 21 according to a second embodiment has a cylindrical hollow passage 23 into which the cord 3 can be inserted and a flange portion 25 at its first end which is retained by the cord guard retainer 9 in the half housing 7. Furthermore, the cord guard 21 comprises a tapering wall portion 27 the wall thickness of which gradually reduces from the flange portion 25 toward the second end and a constant wall portion 29 extending away from the tapering wall portion 27 with its wall thickness constant. Provided between the tapering wall portion 27 and the constant wall portion 29 is a sharp transition 31 which is more sharply tapering wall than the tapering wall portion 27, e.g. a sharp transition occurs between the two portions 27 and 29. Also, a thicker wall ring flange 33 is provided along the periphery of the second free end of the constant wall portion 29.

The cord guard 21 according to the second embodiment is also for use with an electric screw driver. The wall thickness and the length of the constant wall portion 29 of the cord guard 21 are determined such that the constant wall portion 29 is provided with a bending strength low enough that it is flexed smoothly ahead of the sharp transition 31, together with the cord 3, when a load approximately equal to the weight of the cord 3 is applied as a bending load. On the other hand, the tapering wall portion 27 is provided with a bending strength higher than that of the constant wall portion 29 so that it can hardly be flexed or bent with such a light load as is approximately equal to the weight of the cord 3.

By adopting the cord guard 1 or 21 according to the aforementioned embodiments, even in cases where an instrument is swung up and down over and over again with a load approximately equal to the weight of the cord applied, such as a case where a worker installs a lightweight ceiling with an electric screw driver, the cord 3 is flexed smoothly together with the constant wall portion 15 of the cord guard 1 or the constant wall portion 29 of the cord guard 21. Therefore, the cord 3 is never abruptly bent or kinked at the second free end of the cord guard 1 and 21, thereby largely improving the durability of the cord. Also, the constant wall portions 15 and 29 are prevented from being split in an axial direction, despite having their strength intentionally decreased. Because, the thicker wall ring flanges 17 and 33 are provided along the periphery of the second free ends of the constant wall portions 15 and 29. Accordingly, the durability of the cord guards 1 and 21 themselves is not lost. These cord guards 1 and 21 can be produced by injection molding, for example, vinyl chloride resin or synthetic rubber.

Figure 3:
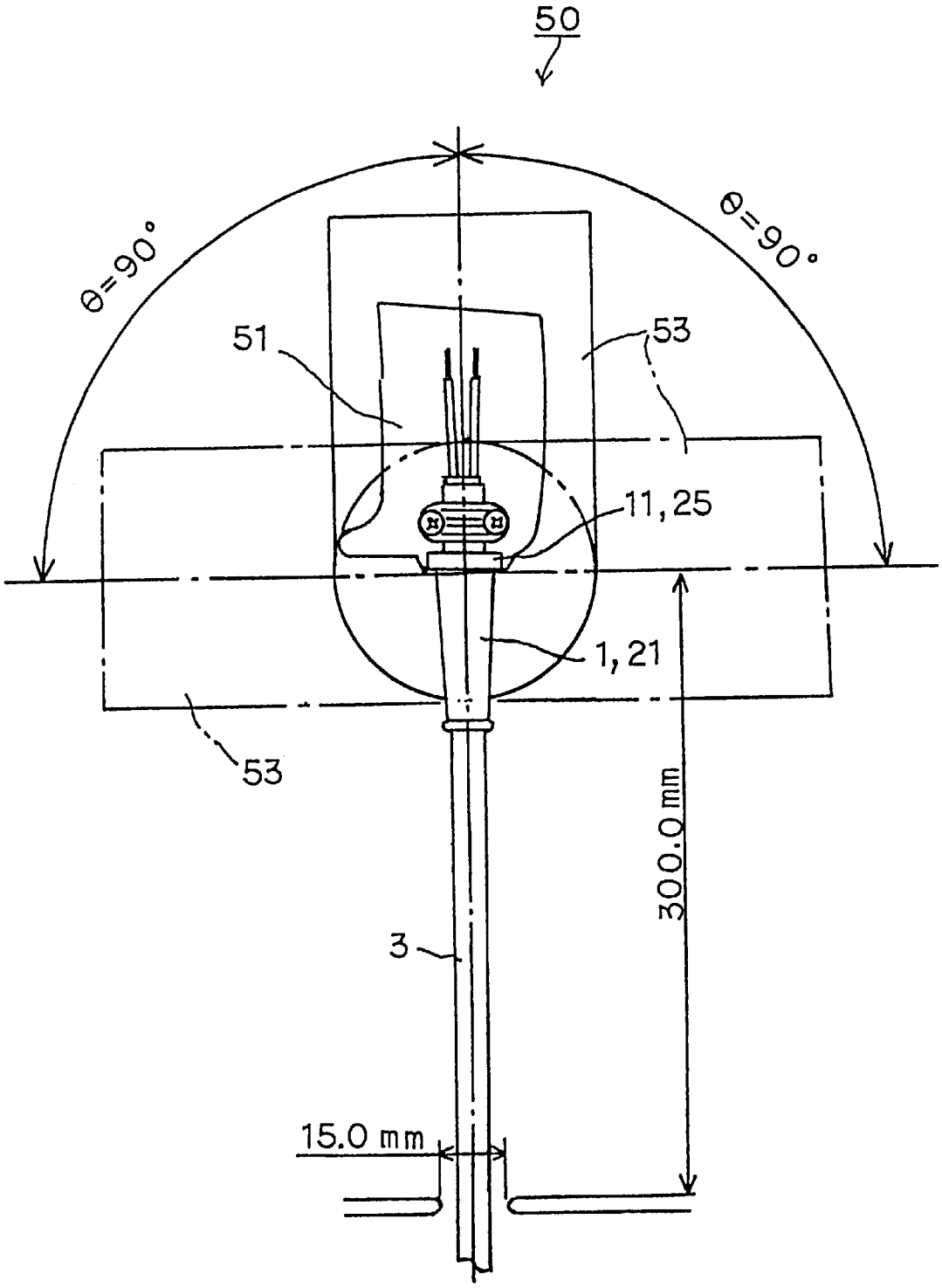
FIG. 3 is a front view showing the schematic structure of an experimental unit durability tests.

The fact that the durability of the cord is largely improved in cases where the cord guard 1 or 21 according to either embodiment is used, compared with the cases where a conventional cord guard is used, is now described on the basis of experimental results. Durability tests were conducted based on UL45, which is the U.S. standard, employing an experimental unit 50 as shown in FIG. 3. In the experimental unit 50, a simulation handle portion 51 onto which the cord guard 1 or 21 and the cord 3 are mounted is fixed to a movable plate 53. The moveable plate 53 is rotated clockwise and counterclockwise, about an angle of 90 degrees in each direction, centered on the lower end position (as shown) of the flange portion 11 or 25 of the cord guard 1 or 21, thereby applying bending loads to the cord guard 1 or 21 and the cord 3. After repeating this operation until the cord 3 is completely disconnected, the durability of the cord can be evaluated from the number of repetitions. A weight of 450 g is attached to the lower end of the cord 3. Also, the frequency of repetition is set, namely, 10 times of reciprocation per minute. Furthermore, in order to recognize a complete disconnection of the cord 3, lead wires of the cord 3 are short-circuited with an electric current flowing therein. The number of repetitions are counted up to the moment the electric current is cut off.

Figure 4A:
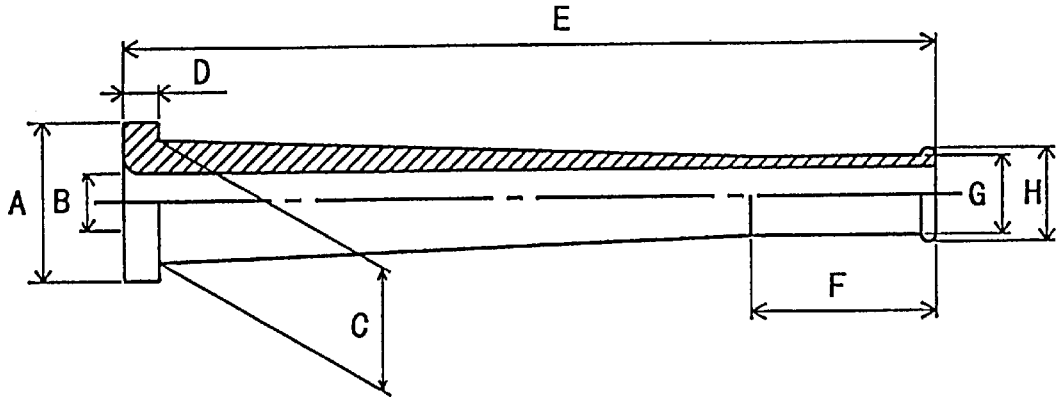
FIGS. 4A, 4B and 4C are the front view, partially in cross section, showing the dimensions and shape of the cord guards according to embodiments used for the durability tests.
Figure 4B:
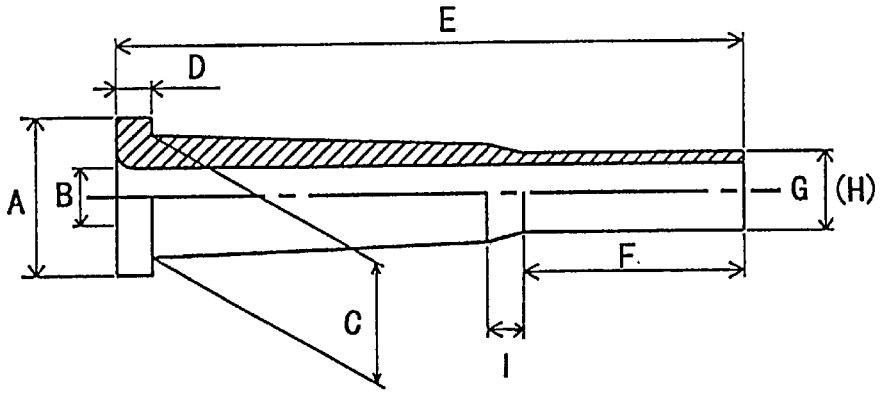
Figure 4C:
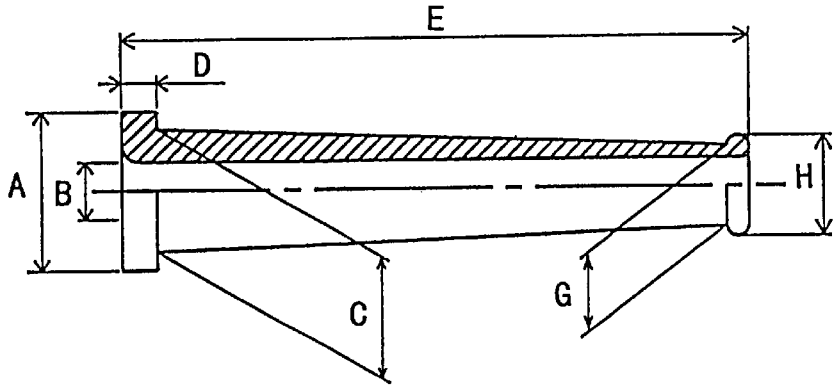
FIG. 4C PRIOR ART

In the durability tests based on UL 45, the cord guards dimensioned and shaped as shown in FIG. 4A and made of synthetic rubber (hereinafter referred to as "Embodiment 1") were employed as those corresponding to the cord guard 1 according to the first embodiment. Also, the cord guards dimensioned and shaped as shown in FIG. 4B and made of vinyl chloride resin or of synthetic rubber (hereinafter referred to as "Embodiment 2") were employed as those corresponding to the cord guard 21 according to the second embodiment. Furthermore, the cord guards dimensioned and shaped as shown in FIG. 4C and made of vinyl chloride resin (hereinafter referred to as "Conventional Example") were employed as conventional cord guards. Embodiment 1 and Conventional Example were made by injection molding. Embodiment 2 was made by manually cutting a conventional injection molded product into the dimensions and shape as shown in FIG. 4B. The wall thickness of the constant wall portions of Embodiments 1 and 2 was 1.5 mm.

A Table showing the compared cord guard dimensions in millimeters as shown in FIGS. 4A, 4B and 4C is set forth below.

| | A | B | C | D | E | F | G | H | I |
|---|---|---|---|---|---|---|---|---|---|
| FIG. 4A Embodiment | 22.0 | 8.0 | 17.0 | 4.8 | 110.0 | 250 | 11.0 | 13.0 | 0.0 |
| FIG. 4B Embodiment | 22.0 | 80 | 17.0 | 4.8 | 85.0 | 30.0 | 11.0 | 11.0 | 5.0 |
| FIG. 4C Conventional Example | 22.0 | 8.0 | 17.0 | 4.8 | 85.0 | 0.0 | 12.0 | 15.0 | 0.0 |

As a result of testing durability with two samples of the Conventional Example, complete disconnection was detected after 32,566 repetitions and 36,379 repetitions, respectively. In addition, the places where the complete disconnection was generated were centered around the outlets from the cord guards. On the other hand, although two samples were also tested as to Embodiment 1, no complete disconnection was detected in either sample even after loads were repeatedly applied 1,000,000 times for each sample. With respect to Embodiment 2, made of vinyl chloride resin, three samples were tested. As a result, in one sample complete disconnection was generated after 429,341 repetitions, and in the other two samples no complete disconnection was generated after 534,257 repetitions and 711,709 repetitions respectively. In short, in two samples out of three, the durability of more than 500,000 repetitions were confirmed. Two samples were also tested for Embodiment 2, made of synthetic rubber. As a result, one was completely disconnected after 392,511 repetitions, and the other was not completely disconnected after 414,435 repetitions.

In view of these results, it can be determined that the durability of a cord with Embodiment 1 is approximately thirty or more times that of a cord with Conventional Example. Furthermore, the durability of a cord with Embodiment 2 can be judged approximately ten or more times that of a cord like the Conventional Example.

As aforementioned, by adopting the cord guard 1 or 21 according to the embodiments, even though a bending load is repeatedly applied to the cord and the cord guard, with a light load approximately equal to the weight of the cord applied thereto, the durability of the cord can be largely improved, at least 10 times compared with the case where a conventional cord guard is employed. Such an outstanding improvement in the durability of cords would not be easily expected prior to conducting the tests. It was proved by the durability tests that the cord guards according to the embodiments had an extremely outstanding effect.

The preferred embodiments of the present invention have been described, however, it goes without saying that the present invention is not restricted to such embodiments and may be practiced or embodied in still other ways without departing from the subject matter thereof.

Furthermore, the cord guards according to the above described embodiments are for use with electric screw drivers, however, the present invention may be applied to the cord guards for various kinds of power tools other than electric screw drivers as well as other electrical machinery and apparatus. In any event, it is expected that the durability of cords is extremely improved just as shown by the experimental data.

In conclusion, according to the present invention, in the event that a bending load is repeatedly applied to a cord and a cord guard, with a light load approximately equal to the weight of the cord applied thereto, the durability of the cord can be largely improved and, therefore, the frequency of repair of the cord can be reduced, thereby largely enhancing working efficiency.

Since certain changes may be made in the above described, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A cord guard for an electrical cord attached to an electrical instrument or tool, the cord guard comprising:

a tubular portion comprising a spaced apart attached end and free end defining a cylindrical bore therebetween through which the electrical cord may be passed;

said attached end being for attachment of the cord guard to the tool;

said tubular portion further comprising a thicker wall section having a predetermined length adjacent said attached end and a thin-walled section having a constant inner and outer diameter and a predetermined length adjacent said free end; and said thicker wall section tapering to toward said thin-walled section.

2. The cord guard according to claim 1, wherein said thicker wall section and said thin-walled section are contiguous with and spaced apart by an intermediate transition taper.

3. The cord guard according to claim 1, wherein the bending strength of said thin-walled section is such that the thin-walled section will bend when a load approximately equal to a weight of the electrical power cord is applied as a bending load to the cord guard.

4. The cord guard according to claim 1, wherein the bending strength of said thicker wall section is such that the thicker wall section will resist bending when a load approximately equal to a weight of the electrical power cord is applied as a bending load to the cord guard.

5. The cord guard according to claim 1, wherein an outer perimeter of said free end has a thicker wall ring flange.

* * * * *